United States Patent [19]

Benaroya

[11] 4,412,476

[45] Nov. 1, 1983

[54] TANDEM MACHINE WITH OPPOSED FREE PISTONS

[76] Inventor: Henry Benaroya, 41, Bld du Commandant Charcot, Neuilly-sur-Seine 92200, France

[21] Appl. No.: 229,561

[22] PCT Filed: May 6, 1980

[86] PCT No.: PCT/FR80/00070

§ 371 Date: Jan. 7, 1981

§ 102(e) Date: Dec. 31, 1980

[87] PCT Pub. No.: WO80/02442

PCT Pub. Date: Nov. 13, 1980

[30] Foreign Application Priority Data

May 7, 1979 [FR] France ..... 79 11513

[51] Int. Cl.[3] ..... F01B 7/02; F01B 1/00

[52] U.S. Cl. ..... 92/75; 92/146; 92/151; 417/341

[58] Field of Search ..... 92/151, 152, 146, 75; 417/339, 393, 340, 341, 401

[56] References Cited

U.S. PATENT DOCUMENTS

| | | | |
|---|---|---|---|
| 2,956,555 | 10/1960 | Brown | 123/56 |
| 3,669,571 | 6/1972 | Benaroya | 417/341 |

FOREIGN PATENT DOCUMENTS

| | | | |
|---|---|---|---|
| 1188375 | 3/1959 | France | 417/341 |
| 1491208 | 7/1967 | France . | |
| 94629 | 10/1969 | France . | |
| 852552 | 10/1960 | United Kingdom | 417/341 |

*Primary Examiner*—Paul E. Maslousky

*Attorney, Agent, or Firm*—Larson and Taylor

[57] ABSTRACT

An opposed free piston tandem machine includes at least two drive piston-cylinder groups A and B and compressor cylinders and movable parts of this machine constitute two trains.

The compressor cylinders of the outer movable train are arranged outside cross-pieces (23, 24) on which the drive pistons and outer compressors (3, 6, 15, 16, 17, 18) are fixed and which are joined together by linking rods (25, 26). The machine can include several drive units and several compressor units, and constitute an auto-generator of gas.

10 Claims, 4 Drawing Figures

TANDEM MACHINE WITH OPPOSED FREE PISTONS

BACKGROUND AND SUMMARY OF THE INVENTION

The invention relates to tandem machines with opposed free pistons comprising at least two groups of drive piston-cylinders arranged parallel beside one another and at least two compressor elements, each of these drive piston-cylinder groups comprising two aligned cylinders in each of which two opposed drive pistons work, the two outer drive pistons of each group being connected to compressor pistons through outer cross members fixed to one another by at least one linking element, so that an outer movable train is thus formed, whilst the two inner drive pistons of each group are connected together and to other compressor pistons to form thus an inner movable train.

In these machines the outer movable train is subjected to longitudinal vibrations created by the harmonics of the periodic forces as well as to bending vibrations created by dissymmetries of operation in the drive piston-cylinder groups, these dissymmetries being due particularly to differences in the combustion speed, in the combustion advance, in the state of the injectors, etc.

One of the parameters influencing the amplitude of these vibrations most unfavorably is the leverage length through which the compressor piston rods are connected to the abovesaid outer transverse parts (cruciform parts).

The invention is aimed notably at obtaining a shortening of these leverages and, consequently, a reduction in the amplitude of the abovementioned vibrations.

To this end, the compressor pistons forming part of the outer movable train are arranged outside the transverse parts of this train, whilst the drive pistons and the one or more linking elements forming part of this same movable train are on the inner side of said transverse parts.

In the case where each of the transverse parts of the outer movable train is mounted, so as to be slidable thereon, on a rod or a tube which extends between two fixed supports and which are to be found on each side of said part, it is advantageous to fix the cylinders of the compressor pistons forming part of this movable train on the outer support of said rod or of said tube.

To obtain high power, one is led to provide, on each side of the inner cross member, four inner drive pistons movable along the drive cylinders arranged at the corners of a rectangle and two compressor pistons sliding in the inner compressor cylinders whose axes pass outside said rectangle, the outer movable train comprising two outer cross members connected through at least one tie rod, each bearing four outer drive pistons movable in four of said drive cylinder and two compressor pistons sliding in outer compressor cylinders.

One of the problems which then occurs is constituted by the intrinsic mass between the inner and outer movable trains, which it is necessary to compensate by the addition of masses which cause considerable stresses on the synchronising means; another problem is constituted by the dimensions and the mass which the cross-members reach, which must transmit large and alternating forces between compressor pistons and drive pistons.

The invention is also aimed at reducing the mass of each of the trains in this case, by acting notably on that of the cross members which constitute an important element thereof, and at balancing these weights intrinsically as far as possible.

For this purpose, the axes of the inner compressor cylinders pass through the extension of the small median of said rectangle whilst the outer compressors, arranged outside said rectangle, pass through the extension of the large median of the latter.

One embodiment of the tandem machine according to the invention and of modifications are shown in the accompanying drawings.

SHORT DESCRIPTION OF THE DRAWINGS

Figure 1:
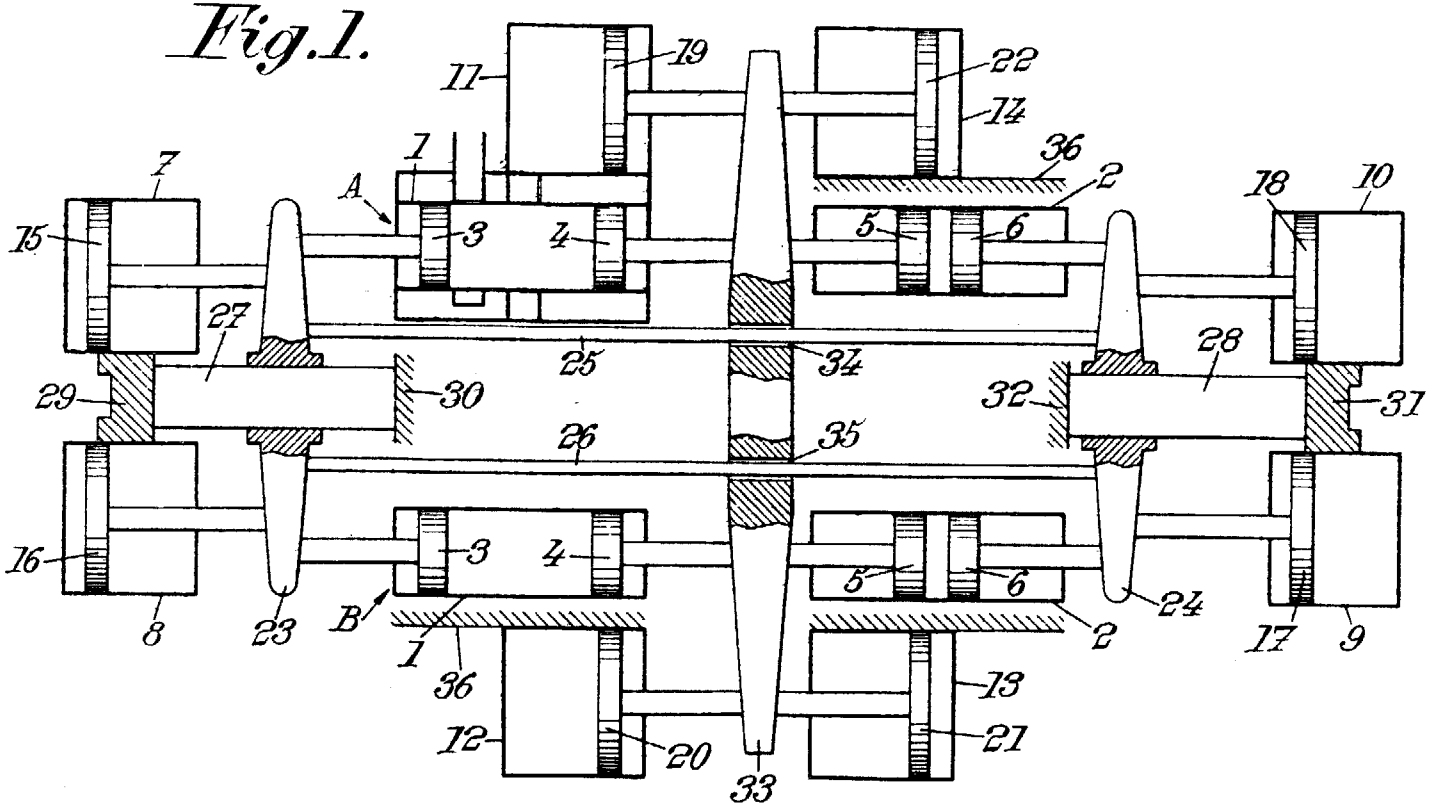
FIG. 1 is a diagrammatic view, in longitudinal section of a machine having a "flat" configuration.
Figure 2:
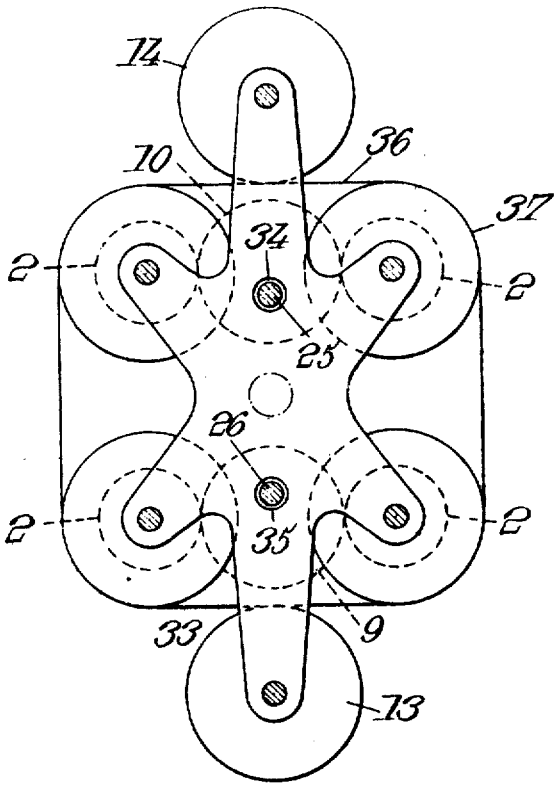
FIG. 2 is a cross section of a machine constituting a modification.
Figure 3:
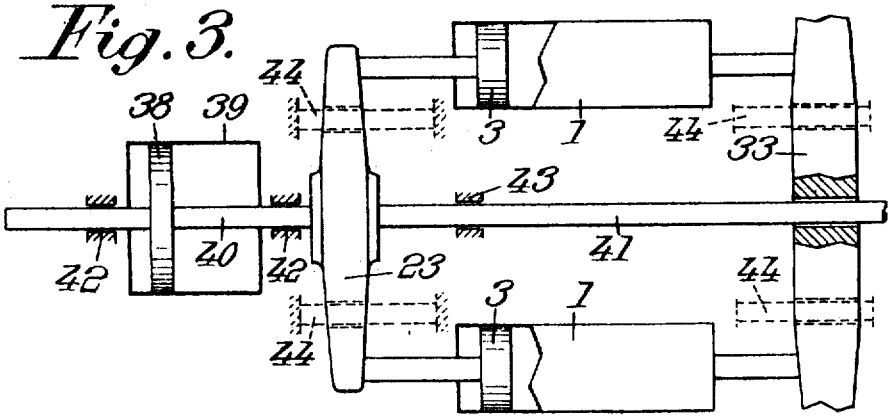
Figure 4:
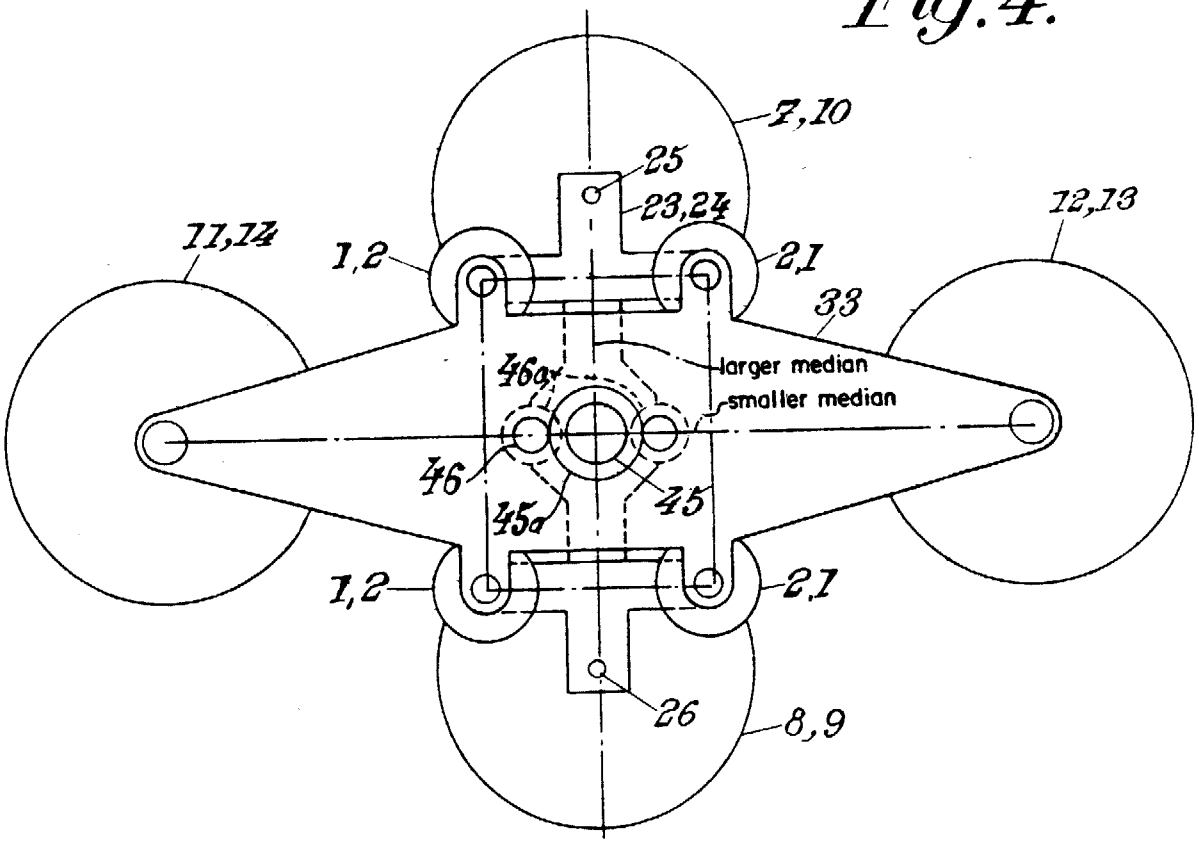

FIG. 3, similar to a part of FIG. 1, shows another modification;

FIG. 4, similar to FIG. 2, is a schematic diagram showing the arrangement of the axes of the drive cylinders and of the compressor cylinders of yet another modification.

DETAILED DESCRIPTION OF PREFERRED EMBODIMENTS

The machine illustrated in FIG. 1 comprises two groups of drive piston-cylinders A and B but it could include a greater number of drive piston-cylinder groups. Each of these groups comprises two aligned drive cylinders 1 and 2. In each of these cylinders two opposed drive pistons 3, 4 and 5,6, work. Each of these cylinders is encircled by scavenging and exhaust manifolds communicating with the compartment bounded by the pistons by means which are shown, very diagrammatically, only on one of the cylinders 1.

The machine includes, in addition, eight compressor cylinders 7, 8, 9, 10, 11, 12, 13, 14 in which the compressor pistons work 15, 16, 17, 18, 19, 20, 21, 22, worked. The compressor cylinders are advantageously arranged so that the compressor pistons operate with a dual action. The intake and delivery valves which are on both sides of the compressor cylinders are not shown in FIG. 1, their arrangement being conventional.

The movable members may be regarded as distributed between an outer train and an inner train.

The outer drive pistons 3 and 6 of the two groups of drive piston-cylinders A and B as well as compressor pistons 15, 16, 17, 18 of the outer compressor cylinders 7, 8, 9, 10 form part of the outer movable train in the axial direction. To this end, the rods of these drive and compressor pistons are fixed to outer cross members 23, 24 connected by two rods or ties 25, 26. The cross members 23, 24 are mounted, slidably, on rods or tubes 27, 28 which are fixed on both sides of these cross parts on fixed supports 29, 30 and 31, 32 which form part of the frame of the machine. In a modification, each of the parts 23 and 24 is fixed to a corresponding section of rod or tube which slides in two bearings fixed to the frame of the machine, each placed on one side of the part.

According to the invention and to reduce the radial length of the outer transverse parts 23, 24, the compressor elements of the outer movable train are arranged on the outer side of the parts 23, 24, whilst the outer drive pistons 3 and 6 of the same movable train as well as the connecting rods 25 and 26 are to be found between the cross members 23, 24, that is to say on the inner side of these parts.

The reduction in weight of the movable members can be obtained through this arrangement is due to several causes, which will now be briefly indicated. It should first be recalled that the forces are imposed and must correspond to the allowable fatigue stresses in the metal constituting the parts of the movable train. These stresses, for given forces, vary according to the size of the cross-members 23 and 24 and the length of the lever arm presented, with respect to the center of the cross-members, by the various forces applied (by the engines, the compressors and the tie-rods): by placing the compressor cylinders close to the axis (which is possible since it suffices to leave the radial space necessary for the frame 29), the leverage is reduced, hence the stresses for equal forces, hence the cross-section to be given to the cross-member. In addition, smaller radial bulk corresponds obviously to a smaller mass and to less sensitivity to vibrations. A reduction in the weight is moreover very advantageous since it enables the number of strokes per unit time to be increased and hence the power of the machine (product of the energy supplied per cylinder and the number of cycles per unit time).

Advantageously, the compressor cylinders 7, 8 and 9, 10 in which the compressor pistons 14, 16, 17, 18 forming part of the outer movable train work, are fixed respectively to the parts 29 and 31 of the frame of the machine to which the outer ends of the rods or tubes 27, 28 are also fixed.

The inner movable train comprises the inner drive pistons 4 and 5 of the two drive piston-cylinder groups A and B as well as the compressor pistons 19, 20, 21, 22. The rods of all these drive and compressor pistons are fixed to an inner cross-member 33 in which openings 34, 35 are formed for the free passage of the tie-rods 25, 26 of the outer movable train. The compressor cylinders 11, 12, 13, 14 in which the compressor pistons 19, 20, 21, 22, work are advantageously fixed to the outside of the portion 36 of the frame within which the drive piston-cylinder groups are located.

In this way, the transverse part 33 of the inner movable train has a radial length greater than that of the transverse parts 23, 24 of the outer movable train. In fact, the minimum distance between the inner compressors and the axis is determined by the bulk of the scavenging and exhaust manifolds of the drive cylinders.

In addition to the advantage of the invention already mentioned which consists of the shortening of the transverse parts 23, 24 of the outer movable train and of the reduction in weight of these transverse parts, the invention relates in other advantages. Thus the intake manifolds of the compressor cylinder are well separated for each intake phase, which permits them to be given better dimensions, their simplification and their assembly and dissassembly to be facilitated. This ease of assembly and dissassembly is especially important for the valve-holding plates of the compressor cylinders. In addition, injectors of the drive cylinders are also easily accessible and, consequently, easy to dismount. Moreover, the air discharged by the outer compressors 7, 8, 9, 10 may be cooled separately under very good conditions. Lastly, the outside of the frame which surrounds the drive piston-cylinder groups and on which are mounted only the compressor cylinders of the inner movable train, provides space for the installation of the injection controls which may thus be brought close to the injectors.

The modification illustrated in FIG. 2, where the members corresponding to those of FIG. 1 bear the same reference numerals, includes four drive piston-cylinder groups: in this Figure the radial bulk of the scavenging and exhaust manifolds 37 of the engines has been shown diagrammatically. It is seen that the inner compressors 14 which are supported on the frame 36 cannot be closer to the axis than they are in FIG. 2 due to the fact notably of the presence of the scavenging and the exhaust manifolds encircling the drive cylinders 2.

The modification of FIG. 3 wherein the members corresponding to those of FIG. 1 bear again the same reference numerals, is differentiated from that of FIG. 1 in that the outer train only includes two compressor pistons 38 of which one only is shown. Each of these pistons 38, located in the axis of the machine, moves in a compressor cylinder 39. The pistons 38 are, in the embodiment of FIG. 3, borne by rods 49 fastened to cross-members 23, located in extension of an axial tie-rod 41 which replaces the tie-rods 25 and 26 of FIG. 1. The rods 40 may be constituted by extensions of the tie-rod 41 to which the cross-members 23 are fixed.

In the embodiment illustrated in FIG. 3, the rod 40 is extended beyond the piston 38 and it may thus be supported by guide bearings 42 placed on each side of each cylinder 39. The axial tie-rod 41 is, on its side, guided by two bearings 43 placed in proximity to the cross-members and of which one is visible in FIG. 3. The cross-members 23 may then be either guided only by the axial tie-rod 41 and the rods 40 which carry them and slide in guide bearings 43 and 42, are guided also by sliding on an even number of fixed rods or tubes 44 arranged symmetrically, as indicated by dashed lines in FIG. 3. Rods 44 may also guide the cross-member 33.

In the embodiment shown in FIG. 4, wherein the members corresponding to those of FIG. 1 bear the same reference numerals, the inner cross-member 33, which, due to the fact of the forces to which it is subjected, will generally be machined from a single forged part, is fixed to an axial guide tube 45, slidable in bearings 45*a* separated from one another, by a distance at least equal to three times the diameter of the tube, and fixed to the frame. The cross-member 33 includes two horizontal opposed arms fixed to the rods of the pistons of the inner compressor cylinders 11–14. Two excresences of the cross-member are fixed to the rods of the eight pistons of the inner drive cylinders.

The outer movable train comprises two outer cross-members 23 and 24 of which the span may be made very much less than that of the central cross-member 33, which offers several advantages. On the one hand, one attempts to balance the weights of the inner and outer trains inherently. On the other hand, the stresses undergone by the outer cross-members are substantially reduced, particularly in the course of the driving phase, when the forces of opposite signs are transmitted by the outer drive piston rods and the linking tie-rods 25 and 26 between the cross-members 23 and 24, located in line with the rods of the pistons of the compressor cylinders 7, 10 and 8, 9. This arrangement of the tie-rods enables them to pass outside of the central cross-member 33. It is consequently possible to give them a one-piece constitution and to permit relatively easy dismounting of the cross-member 33.

The central and outer cross-member arrangement which has just been described has important advantages with respect to the arrangement which consists of placing the axis of the inner and outer compressers in the same plane (FIG. 2).

This advantage is apparent if it is remembered that the axis of the drive cylinders 1 or 2 must be arranged at the corners of a rectangle to reconcile at the same time a maximum reduction in space and the need to have access to the injectors, situated in the middle rings of the drive cylinders. By adopting the arrangement shown in FIG. 4, the span of the outer transverse members is reduced, which permits the weight to be reduced in two ways: on the one hand, the planar dimensions are less; on the other hand, the moments of the forces are also reduced. The weight of the inner and outer trains thus tends to be inherently balanced.

The cross-members must be provided with guide means. The first solution consists of providing bearings sliding on fixed guide tubes. However, for a high powered installation, it is more advantageous to constitute the guide means by one or several tubes (46 in FIG. 4) fixed to the cross-member and moving in fixed bearings (46*a* in FIG. 4) whose distance is equal to at least four times the diameter of the tube. If this solution slightly increases the weight of the movable trains, it has on the other hand the advantage of avoiding any bushing, lining and movable oil inlet and of permitting the movable trains to be substantially symmetrical with respect to the longitudinal axis of the machine.

Other modifications also are possible. Thus the tandem machine which has just been described can operate, either as a compressor in which the air compressed in the compressor cylinders is discharged to the outside, or, and preferably, as an autogenerator of pressurized gas in which at least the larger part of the air compressed in the compressor cylinders serves for scavenging and for supercharging the drive cylinders in which the combustion gases expand only incompletely, so that a hot and pressurized mixture composed of combustion gas and scavenging air emerges from the exhaust openings of the drive cylinder, which mixture can be used for driving a turbine.

I claim:

1. A tandem free piston machine comprising:

at least two groups of motor cylinders located parallel to a common axis, each said group including two aligned motor cylinders arranged on opposite sides of a transversal midplane of the machine and each cylinder reciprocably locating an outer drive piston and an inner drive piston arranged for movements in opposite directions, two pluralities of compressor pistons each reciprocably located in a compressor cylinder, first connecting means including a pair of outer cross members and mechanical cross member linking means, said first connecting means rigidly interconnecting said outer drive pistons and a first one of said pluralities of compressor pistons to constitute an outer reciprocating train, second connecting means including an inner cross member and rigidly interconnecting said inner drive pistons and a second one of said pluralities of compressor pistons to constitute an inner reciprocating train, wherein said compressor pistons of said outer train are located outside of said outer cross members in the axial direction while all said drive pistons, said linking means of said outer train and said inner cross-member are located between said outer cross members in the axial direction.

2. Machine according to claim 1 in which each of the cross-pieces of the outer movable train is mounted, so as to be slidable thereon, on a cylindrical guide means which extends between two fixed supports (29, 30 or 31, 32) which are on both sides of said cross-piece, characterised by the fact that the support (29 or 31) of the outer end of said cylindrical guide means serves for the fixing of the cylinders (7,8 or 9, 10) in which the compressor pistons of the outer movable train work.

3. Machine according to claim 1, characterised by the fact that each of the cross-pieces of the outer movable train is fixed to cylindrical guide section, each of said sections sliding in two fixed bearings (45*a*) which are on both sides of said cross-piece.

4. Machine according to any claim 1, 2 or 3, characterised by the fact that the compressor cylinders (11 to 14), of the inner movable train are mounted on a frame (36) which surrounds the drive piston-cylinder groups.

5. Machine according to claim 1, in which the outer cross-members are connected by a single tie-rod constituting said linking means, placed along the axis of the machine, wherein said tie-rod comprises, beyond the outer cross-members, extensions for driving said compressor pistons of said outer train which are placed coaxially to said axis.

6. Machine according to claim 5, characterised by the fact that said extensions extend beyond the said compressor pistons of said outer train in fixed guide bearings (42).

7. Machine according to claim 5 or 6, characterised in that said cross-member are guided by the axial tie-rod which slides in fixed guide bearings (42, 43).

8. Machine according to claim 1, wherein the inner movable train comprises, on each side of the inner cross-member, four inner drive pistons movable along the drive cylinders arranged at the corners of a rectangle having a smaller median and a larger median and two compressor pistons sliding in inner compressor cylinders whose axes pass outside said rectangle; the outer movable train comprises, fixed to each outer cross-member, four outer drive pistons movable in the drive cylinders and two compressor pistons sliding in outer compressor cylinders; and the axes of the inner compressor cylinders pass through an extension of the smaller median of the said rectangle, whilst the axes of the outer compressor cylinders pass through an extension of the larger median of the rectangle.

9. Machine according to claim 8, characterised in that the outer cross-members are guided by two tie-rods arranged in the plane of the axes of the inner compressor cylinders, advantageously, in line with the axes of these inner compressor cylinders.

10. Machine according to claim 8 and 9, characterised in that each cross-member is provided with guide means constituted by at least one tube fixed to the cross-member and moving in fixed bearings whose distance is equal to at least four times the diameter of the tube.

* * * * *